US005752459A

United States Patent [19]

Rexroad

[11] Patent Number: 5,752,459

[45] Date of Patent: May 19, 1998

[54] NET WITH FLATTENED SURFACE MEMBERS CONNECTED AT SEWN INTERSECTIONS

[76] Inventor: John Rexroad, 12 Jackson Rd., Killingworth, Conn. 06419

[21] Appl. No.: 557,851

[22] Filed: Nov. 14, 1995

[51] Int. Cl.[6] ..... D05B 97/00

[52] U.S. Cl. ..... 112/440; 87/12; 182/196; 482/35

[58] Field of Search ..... 112/440, 441, 112/413, 415, 416; 182/196, 199; 482/35, 36, 37; 87/12

[56] References Cited

U.S. PATENT DOCUMENTS

| | | | |
|---|---|---|---|
| 686,182 | 11/1901 | Wright | 182/196 |
| 1,700,192 | 1/1929 | Appleyard . | |
| 2,194,865 | 3/1940 | Mizugoshi . | |
| 2,407,031 | 9/1946 | Morcaldi . | |
| 2,600,395 | 6/1952 | Domoj et al. . | |
| 2,659,956 | 11/1953 | Lilienfeld . | |
| 2,792,617 | 5/1957 | Haller . | |
| 2,817,263 | 12/1957 | Pedley et al. . | |
| 2,823,576 | 2/1958 | Needham et al. . | |
| 2,925,141 | 2/1960 | Frieder et al. | 182/196 |
| 3,008,711 | 11/1961 | Dillon | 482/36 |
| 3,039,348 | 6/1962 | Grabowsky et al. . | |
| 3,047,860 | 7/1962 | Swallow et al. . | |
| 3,170,611 | 2/1965 | Gullen . | |
| 4,000,344 | 12/1976 | Dilbey . | |
| 4,158,985 | 6/1979 | Looker et al. . | |
| 4,619,108 | 10/1986 | Hotta . | |
| 4,651,620 | 3/1987 | Lyons . | |
| 4,892,210 | 1/1990 | Kupersmit . | |
| 4,895,366 | 1/1990 | Bartasius . | |
| 4,948,129 | 8/1990 | Bartasius . | |
| 5,328,310 | 7/1994 | Lockney . | |

FOREIGN PATENT DOCUMENTS

| | | | |
|---|---|---|---|
| 797133 | 6/1958 | United Kingdom | 182/196 |

OTHER PUBLICATIONS

Smith, "Navy Drawing", Dept. of Navy, p. 3, May 1987.

*Primary Examiner*—Peter Nerbun
*Attorney, Agent, or Firm*—Perman & Green, LLP

[57] ABSTRACT

A net utilizes members having at least one surface which is flat and causes the at least one flat surface of the members to confront each other and be connected by a sewn connection. The generally flat orientation of the members permits the members to be readily repeatedly connected with uniform results. The invention also utilizes the flat surfaces of the members to create an out of plane design whereby the flat surfaces of the members extend perpendicularly to the plane which includes the net. Connections can further be made by providing a hollow member and inserting another member into it at a first point and then threading the inserted member through the hollow member until it exits by piercing the hollow member or by causing the inserted member to be sewn to the hollow member therewithin.

10 Claims, 16 Drawing Sheets

NET WITH FLATTENED SURFACE MEMBERS CONNECTED AT SEWN INTERSECTIONS

CROSS REFERENCE TO RELATED APPLICATIONS

The present invention relates to U.S. application Ser. No. 08/238,915 filed on May 6, 1994, now U.S. Pat. No. 5,575,458, in the name of Rexroad et al and entitled "IMPROVED MESH STRUCTURE AND RELATED METHOD", and relates to U.S. application Ser. No. 08/414,185 filed on Mar. 31, 1995, now U.S. Pat. No. 5,622,094, in the name of Rexroad and entitled "HOLLOW BRAID NET AND METHOD OF MAKING".

BACKGROUND OF THE INVENTION

The present invention relates to net structures and deals more particularly with a net comprised of members having a substantially flat cross-section which are readily adaptable to be connected to one another at points constituting nodes of the net by sewn intersections or crossed pierced-intersections.

In the past, the formation of intersecting weft and warp members, or so called rung or rail members has been done either by knotting, splicing or by cross-splicing of the intersecting members to one another. While previously nets with knotted or cross-pierced intersections provide for a substantially strong overall support structure, the creation of the netting structure is nevertheless highly labor-intensive, thereby driving up the unit cost of these nets accordingly.

The present invention provides a flat rope member which ideally lends itself to being sewn to the corresponding flat surface of another flat rope member supported on a flat work surface such that cross-rope pieces can be mechanically attached, for example, by stitching. As such, the rope member can be precut in lengths measured to the exact dimensions of the net to be fabricated and stitched to other intersecting lengths of flat rope at predetermined spacings which can be reproduced with great repetition and accuracy. Additionally, playlands or other like recreational facilities have certain themes or appearances which tend to be part of the overall makeup of the play area. For example, in some play areas a jungle theme may prevail and a netting with appropriate coloring and design, for example, zebra stripes, may be used to add to the jungle theme. Also, since such nets are used by children and are made to be gripped and pulled on by a child, it is important that the material from which the net members are made do not scratch or abrade the skin of the child. Additionally, since one application of these nets may be for use in playgrounds or children's playlands where children often play without shoes, it is also necessary to provide net material which is constructed such that it cushions the otherwise concentrating loads acting upon a foot as it climbs a net without shoes. It is furthermore noted that it is desirable to keep the free ends of the crossing members out of contact with the child who is using the net because the end can be the source of the unravelling and possible abrasion when it is gripped, pulled or pushed on.

Accordingly, it is an object of the present invention to provide a net formed from intersecting members, each of which members having a generally flat cross-sectional shape with the flat surfaces of which being attached at sewn intersections to create the net matrix.

The object of the invention is also to provide a net of the aforementioned type wherein the intersecting members are formed from a multi-filament flat rope material allowing the rope to be readily gripped and used by a small child.

Still a further object of the invention is to provide a net of the aforementioned type wherein the crossing members constituting the net include a design integrally formed with the material to take on a given theme of the environment which surrounds the net.

Still a further object of the invention is to provide a net of the aforementioned type which can be fabricated by a method whereby the net members are of a precut construction and can be attached to one another to create the netting matrix using a stitched connection.

SUMMARY OF THE INVENTION

A net comprising a plurality of elongate members each having a width dimension which is substantially greater than the thickness dimension thereof so as to present a substantially flat tape-like configuration. The elongate members are arranged in an overlapping matrix of crossing elongate members and connected at intersections which correspond to the crossing of the elongate members to rigidly hold the members at an angle relative to one another. The intersection between two crossing members is secured by a sewn intersection which is sewn through the flat sides of the crossing members so as to join the members intersecting substantially co-planar with one another. The elongate members in one embodiment are formed from a braided belting of multi-filament polypropolyene constructed with braided or twisted cord. The net may also be formed from hollow tubular members having an internal tubular chamber in which a padding material is received which renders the otherwise flattened elongate material in a generally tubular yet yieldable configuration.

The net further may have a border member defining the general shape of the net extending coincidentally through a plane and the flat sides of the border member being disposed perpendicularly to the general plane of the net. The net further including a matrix of crossing members disposed within and connected to the border member which interconnect to one another at nodes which repeat as defined by horizontal and vertical lengths of the border member. The crossing members which make up the matrix of the net further include elongate members which connect to the border member at points therealong such that the flat sides thereof extend parallel to the flat sides of the border and perpendicularly to the plane which includes the net. The crossing members include one and another members each connected at one end thereof to perpendicularly disposed lengths of the border which define a first corner. One of the elongate crossing members pierces the other of the elongate crossing members and the one of the elongate crossing members is thereafter turned laterally 90° after piercing the other of the elongate crossing member and the other of the elongate crossing member pierces the one of the elongate members so that it is turned 90° and proceeds in this direction until cross piercing with a third such crossing member in progression until a plurality of rails and rungs are created between the borders of the net. The crossing members may be formed from a colorfast multi-filament and polypropolyene or polyester hollow rope.

The border is a hollow rope member which is pierced by the free ends of the net crossing members such that a portion of the length of the net members extend into the internal chamber of the hollow border member and are thereafter secured against movement by a stitched connection. The hollow border member may also be pierced by a length of one of the net crossing members and pulled along the length of the border member internally thereof and exits the border member at a point corresponding generally to the location of a node disposed in line with the point where the one of the net crossing members exits the border.

The border member in the out of plane design is a single length of hollow rope which is caused to form a closed shape by connecting the free ends thereof to one another. The connection between the free ends thereof being formed by cross-piercing the ends of the border to one another in an axial direction and thereafter stitching one inserted end of the border member to the pierced section of the border and stitching the other end of the border member to the pierced other section of border.

The matrix of interconnected net crossing members may equally be formed from doubleback lengths of net material which are sewed to the border member at the doubling back point of the members and thereafter extend across the border. Each doubled back length of crossing member is sewn to itself at reconnecting points therealong corresponding to the nodal locations of the member intersections. Juxtaposed ones of the doubleback lengths of crossing members being connected to one another at points intermediate the reconnecting points of the juxtaposed ones of the crossing members so as to create a generally honeycomb configuration of the net structure.

DETAILED DESCRIPTION OF THE PREFERRED EMBODIMENTS

Figure 1:
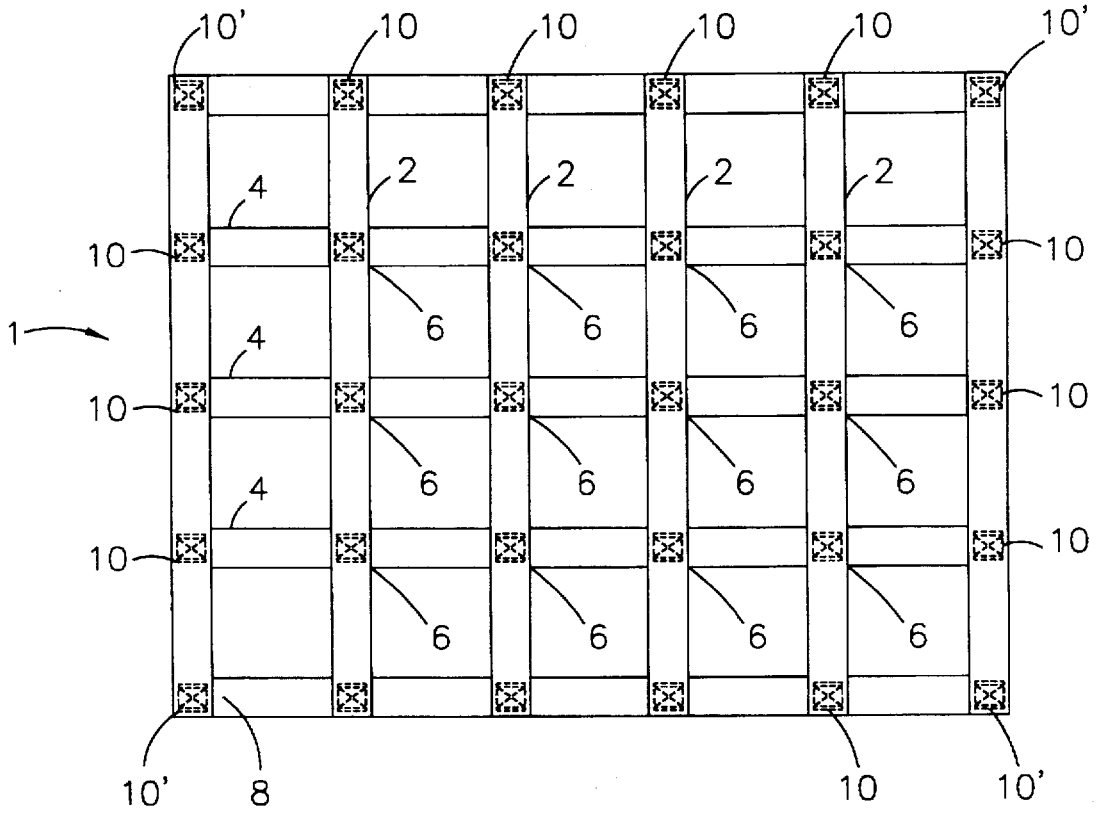
FIG. 1 shows a plan view of a net with zone intersections.
Figure 2:
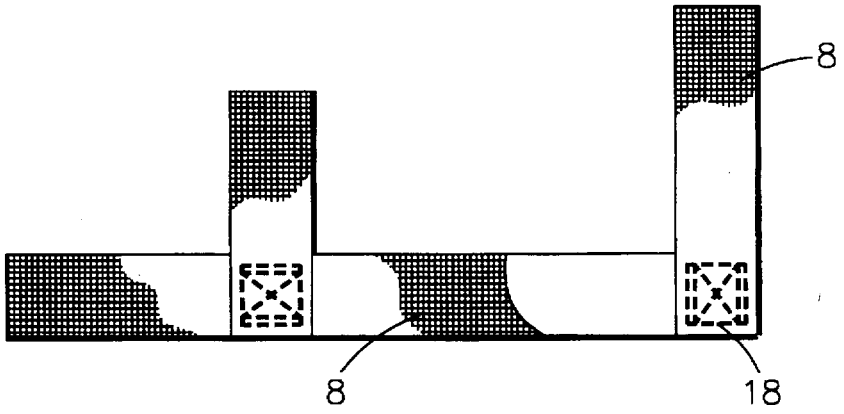
FIG. 2 is an exploded view of a zone corner of the net shown in FIG. 1.
Figure 3A:
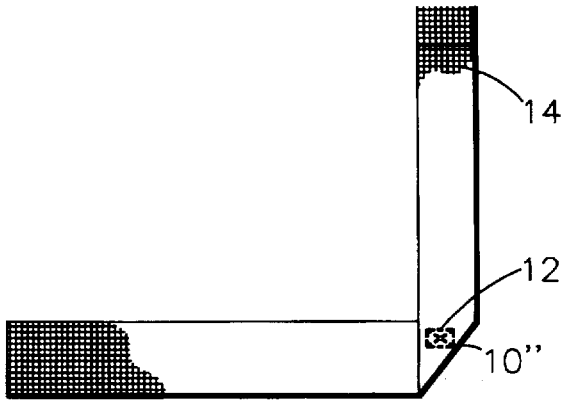
FIG. 3*a* is an alternative embodiment of the net corner shown folded on itself to effect the right angle turn.

FIG. 1 illustrates a net reference generally as 1 and is comprised of a plurality of vertically disposed members 2,2 and a plurality of horizontally disposed members 4,4 which intersect at points 6,6 to define nodes identified by the intersection of perpendicularly oriented ones of the crossing members 2 and 4. The net 1 further includes a border member 8 which in the illustrated embodiment of FIG. 1, is made up of four separate lengths, the free ends of which are respectively connected to one another at corners 10',10' as illustrated in FIG. 2. Connected to the border lengths are vertical and horizontal crossing members 2 and 4 which connect at end juncture points 10,10. The corners of the net identified in FIGS. 1 and 2 at 10',10' are created in the illustrated example by the stitching of overlapped end regions of one horizontal member 4 to a vertical member 2. Alternatively, as seen in FIG. 3*a*, the border may be comprised of a single length of material and the corners of which, identified as 10", may be configured from a single length of material 14 which is folded on itself at a 45° angle and thereafter stitched as indicated at 12 to maintain the right angle turn.

Figure 3B:
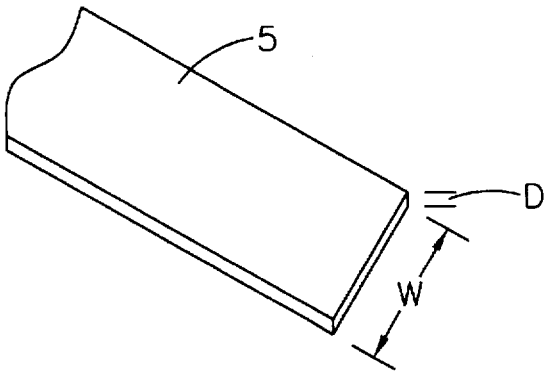
FIG. 3*b* is a fragmentary view of a net crossing member shown in perspective view.
Figure 4A:
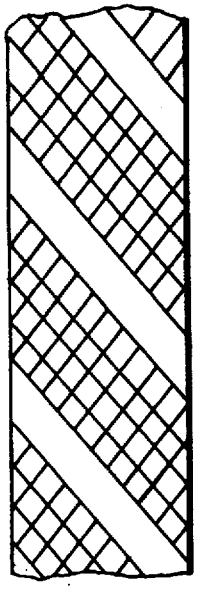
FIG. 4*a* is a fragmentary view showing one type of crossing member material.
Figure 4B:
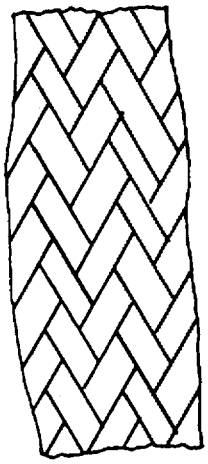
FIG. 4*b* is a fragmentary view showing another type of crossing member material.
Figure 4D:
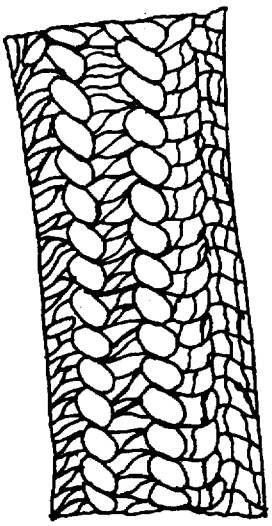
FIG. 4*d* is a fragmentary view showing another type of crossing member.
Figure 4C:
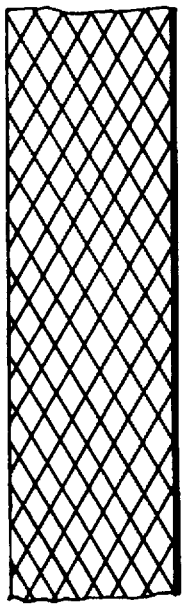
FIG. 4*c* is a fragmentary view showing another type of crossing member material.
Figure 4E:
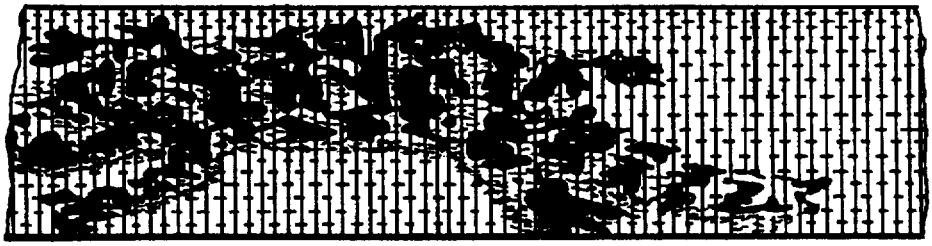
FIG. 4*e* is a fragmentary view showing another type of crossing member material.

As best seen in FIG. 3*b*, the material 5 shown is employed by the nets of the present invention to comprise a portion or the entirety of the border member, as well as comprising the vertical and horizontal members of the net. The netting material 5 is unique in that it is constituted by a flat piece of material having a width dimension W which measures on the order of approximately one to two inches and has a depth dimension d of no more than about one-quarter inch rendering the members a generally tape-like appearance. As is seen in FIGS. 4*a* through 4*e*, the material by which the nets of the present invention are made may vary, depending on the given application. The material shown in FIG. 4*a*, is a hollow braided rope of multi-filament construction having a checkered design. The material shown in FIG. 4*b*, is a hollow braid polyester rope and the material shown in FIG. 4*c* is a hollow braid multi-filament polypropolyene, polyester, NYLON or KEVLAR rope. As shown in FIG. 4*d*, the net construction may alternatively be formed from braided belting comprised of a multi-filament polypropolyene material constructed with twisted cord or may be a braided belting of multi-filament construction with a braided cord rather than twisted cord as shown in FIG. 4*d*. The material shown in FIG. 4*e* is a tubular webbing with a woven design selected to be compatible or for use with a given theme, such as, a jungle or rain forest setting. The netting material shown in each of FIGS. 4*a* through 4*e* are a readily commercially available products and, for example, in the case of the materials shown in FIGS. 4*a*, 4*b*, 4*c* and 4*d* are commercially sold by Gulf Rope & Cordage, Inc. of Mobile, Ala. 36605 and the webbing illustrated in FIG. 4*e* is sold commercially by Blue Ridge Weavers of Easley, S.C. 29641.

Figure 5:
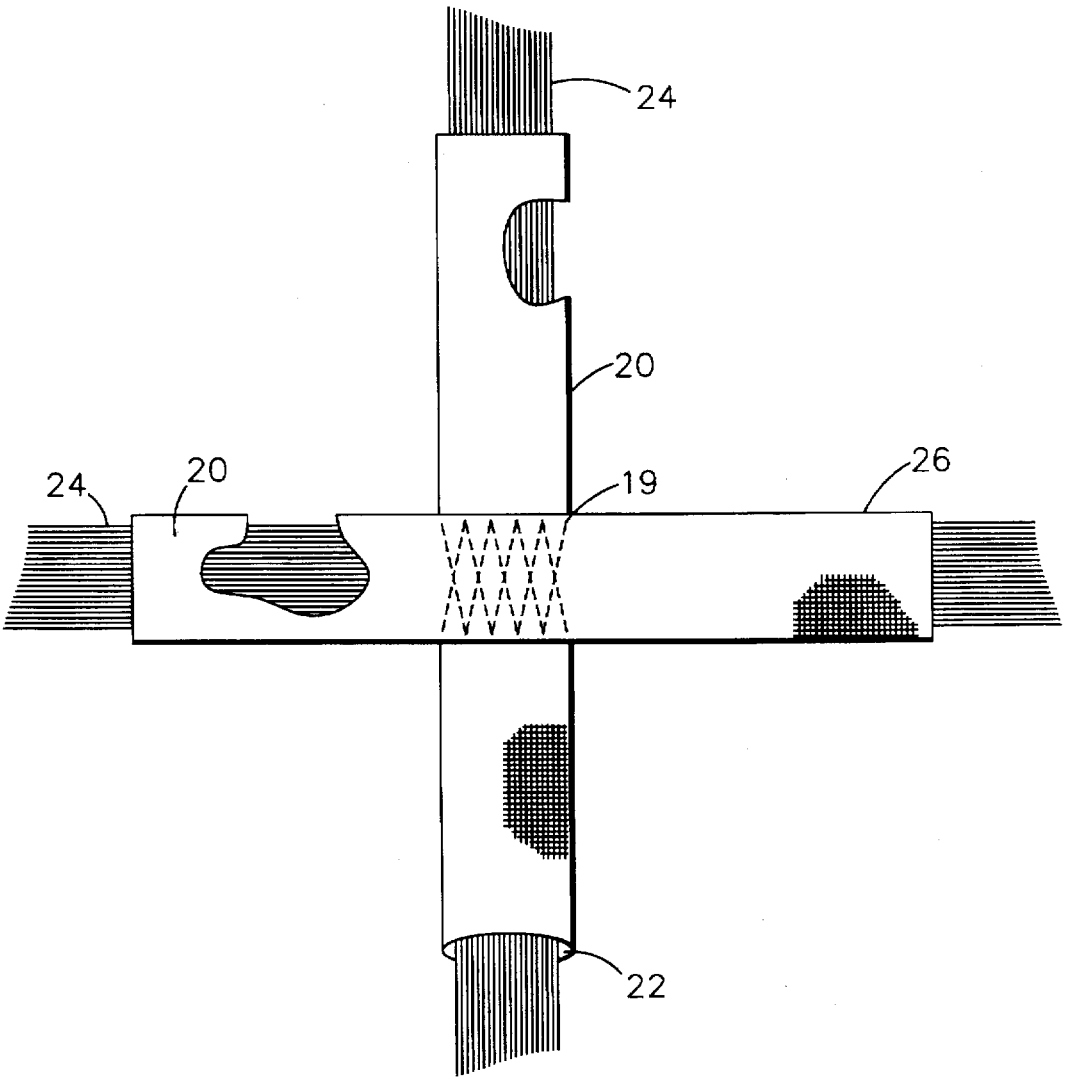
FIG. 5 is a showing of intersecting net members which are of hollow construction and include an inner padding to provide extra mass therefor.
Figure 6:
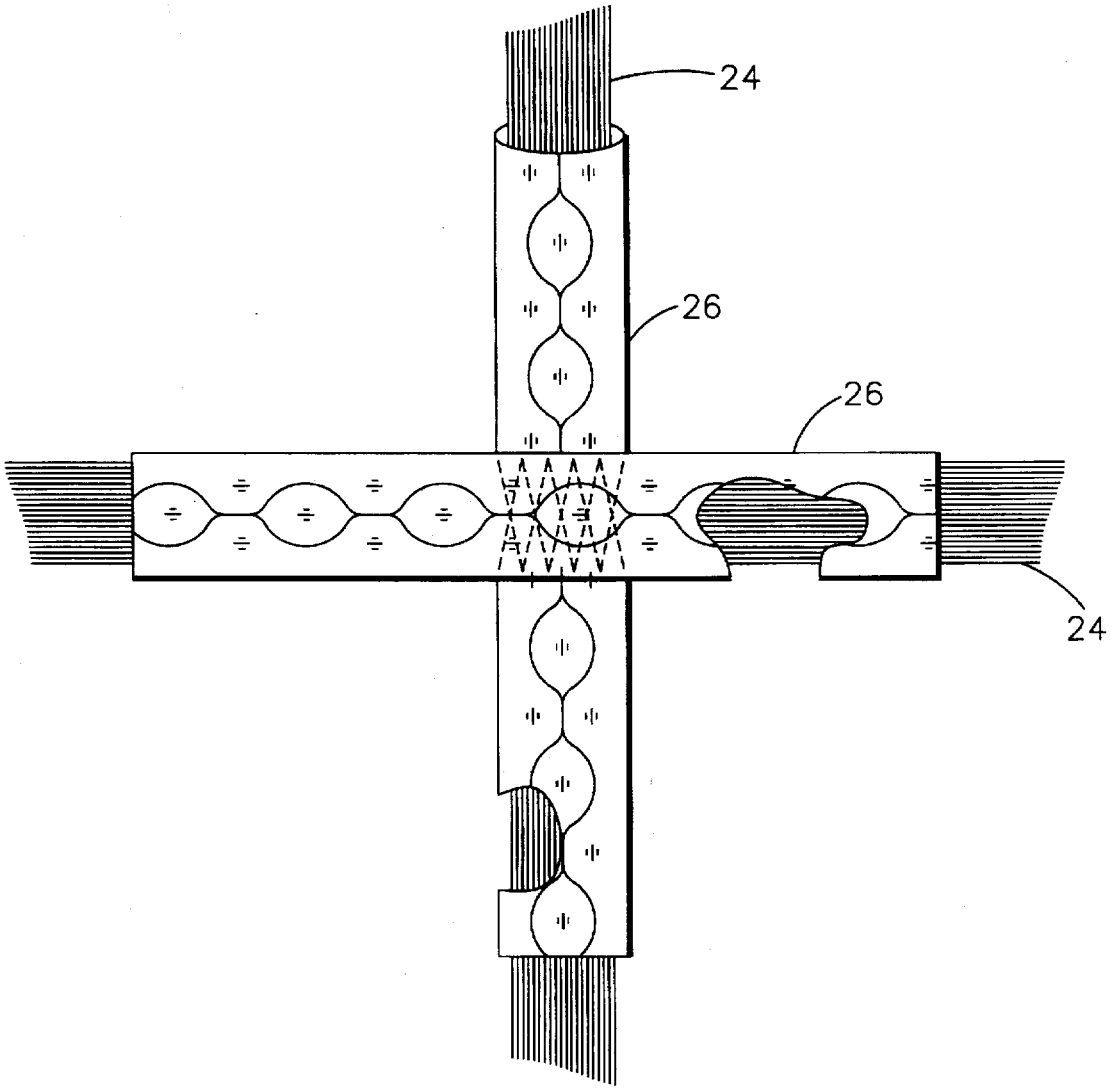
FIG. 6 is an alternative embodiment of the intersection shown in FIG. 5 wherein the members are of hollow construction but stitched with a woven design adding to the net's aesthetic feature.

Referring to FIG. 5, it should be seen that the tubular webbing of FIG. 4*e* is capable of being readily connected to one another by stitching as illustrated in FIG. 5. The material which forms the tubular webbing indicated generally as 20 defines an internal hollow chamber 22 which in the preferred embodiment is filled with a padding material 24 which gives the net members 2 and 4 a bulging or rounded effect likening each member to that of a cylindrical rope. Additionally, the internal padding material 24 provides a cushioning effect for children in the event that the net is used as a climbing net where the child usually climbs on the net with bare feet. In this case, the force concentrating loads otherwise imposed on the arch of the child's foot is better distributed and gives greater mass for gripping, thus causing the climbing experience to be enjoyable by the child. The members 20,20 are connected to one another by a sewn intersection 19 which is stitched through the overlain flat surfaces of the members and through the padding material as well. Thus it should be understood that in the localized regions of the stitched connections 19,19, the rounded effect achieved by the padding in these areas is temporarily lost, but is almost immediately reconstituted before and after each such connection. As seen in FIG. 6, the tubular webbing 26 has a stitched pattern design, in this case, representing a native American configuration which may be used in a compatible-like amusement setting. The padding 24 may be made from various different materials having an elongated form, and in the preferred embodiment, the padding 24 is formed from strands of synthetic loosely twisted filaments or spun material, or can take the form of cotton or a pliable cordage material all of which having sufficient strength in tension to be pulled through the chamber 22 of the tubular webbing. As illustrated in each of FIGS. 5 and 6, the vertically and horizontally disposed padded webbing are connected either by the stitching pattern illustrated as 18 in FIG. 2 or as the pattern 19 in shown in FIG. 5. While the stitching used to effect the connections can take many different patterns, in the illustrated embodiment of FIG. 2, the stitching is a ¾ inch by ¾ inch, box and cross-stitch and in the example of FIG. 5, the stitching is a W—W box stitch either of which can be equally interchanged for the other. The ¾ inch by ¾ inch dimension discussed previously is used for the wider of the members, such as in the case of using the braided belting constructed with braided or twisted cord as best illustrated in FIGS. 4*d* and 8. However, in the instance where a hollow braid such as shown in FIG. 4*c* and 7 are used, a scaled-down version of either of the box and cross or box W—W stitches are used given that the width dimension of these crossing members are somewhat smaller than that of the materials shown in FIG. 4*d* and 8.

Figure 7:
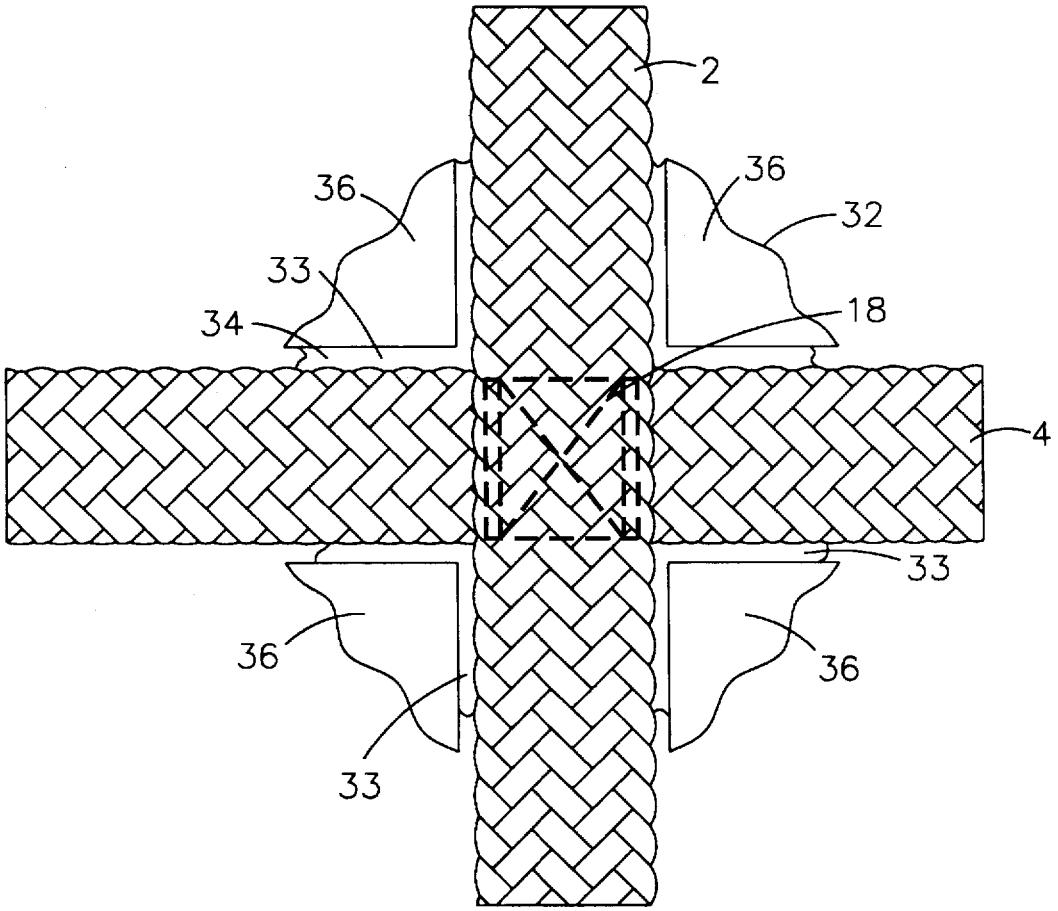
FIG. 7 shows an alternative embodiment of the materials used to construct the members of the net showing a flat hollow braid rope at a sewn intersection.
Figure 8:
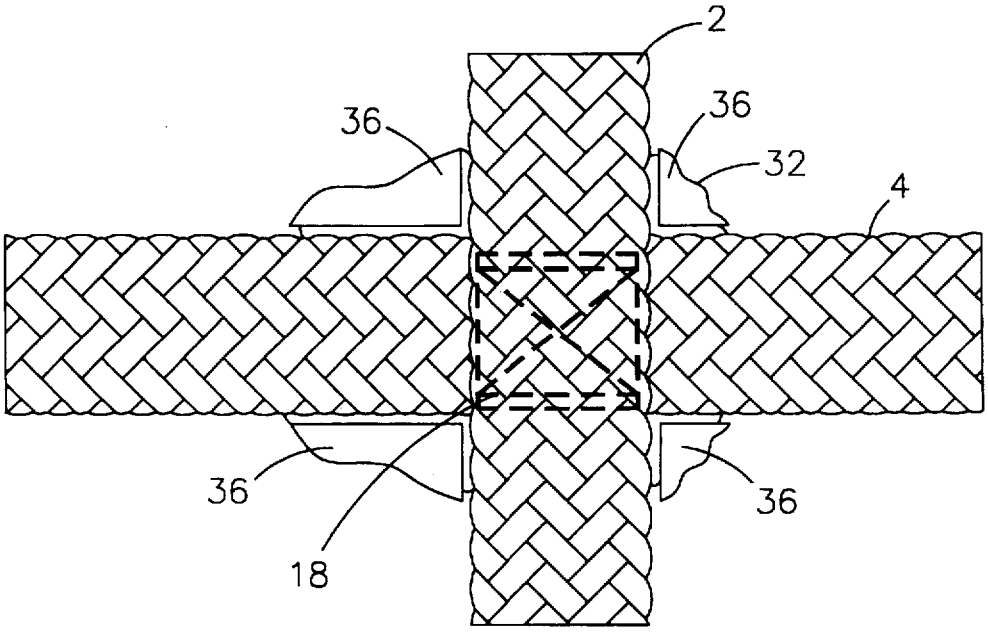
FIG. 8 is another embodiment of intersecting net members at a sewn intersection herein shown as braided belting.

Referring now to FIGS. 7 and 8, and in particular to the method and apparatus used to connect crossing members to one another, it should be seen that the generally flat construction of the net elongate crossing members 2 and 4 permit the net nodes to be assembled by sewn intersections as indicated at 18 and 19 in FIGS. 2 and 5 without the need to knot one member to the other as hitherto known in the prior art. This departure from the prior art provides very significant benefits over those nets which use knotted connections in that the nets of the present invention use less material given that no material is expended in creating a knot or tuck, and the nets of the present invention do not experience stretching of the net at the nodes when loaded which may not be desirable in a given application.

As illustrated in FIG. 7, the apparatus for creating a sewn intersection therein indicated at 18 includes a workpiece support member 32 which makes up part of a sewing apparatus and has in the illustrated embodiment a cruciform support surface 34 defined by a four right angle corner pieces 36,36 which are appropriately spaced from one another serving to create channels 33,33 which receive and maintain the angular orientation of the elongate crossing members 2 and 4 in the crossing relationship so that a sewing step is readily and uniformly conducted on the crossed members. It should be understood however that while the configuration of the tool 32 is illustrated in the preferred embodiment as providing a cruciform shape, it should nevertheless be understood that the tool and its orienting support surface can be configured so as to orient the elongate crossing members in any orientation, such as in the case of the radial net of FIG. 10. Notwithstanding, the use of the tool 32 regardless of the orientations which it constrains the elongate members to take, provides for a highly repetitive and accurate method of net fabrication. That is, by using the tool 32, the operator can simply superimpose one member atop of the other with flat sides, i.e. widths W,W in parallel relationship to one another, and then cause the sewing needle to attach the two members to one another, substantially in the same plane, at the point where the flat surfaces of the members cross one another, such as by the commencing of an automated stitching pattern indicated at 18. Thus, as shown in FIG. 7, the intersection shown therein is a right angle connection between first and second crossing members formed from hollow braid multi-filament polypropolyene rope. These members as shown have a width dimension W which is supported by the cruciform surface 34 such that stitching 18 can be performed at the desired location. As shown in FIG. 8, the indicated net members 2 and 4 are like pieces of braided belting formed from multi-filament polypropolyene fibers constructed either of twisted or braided cord which have a width dimension W substantially equal to the spacings between opposed ones of the corner pieces 36,36 of the tool 32 to provide an appropriate registration system for locating the stitching 18 at the center of the crossed members. For this purpose, the corner pieces 36,36 are adjustable relative to the surface 34 to allow the spacing between corner pieces to closely surround the net members 2 and 4.

Figure 9:
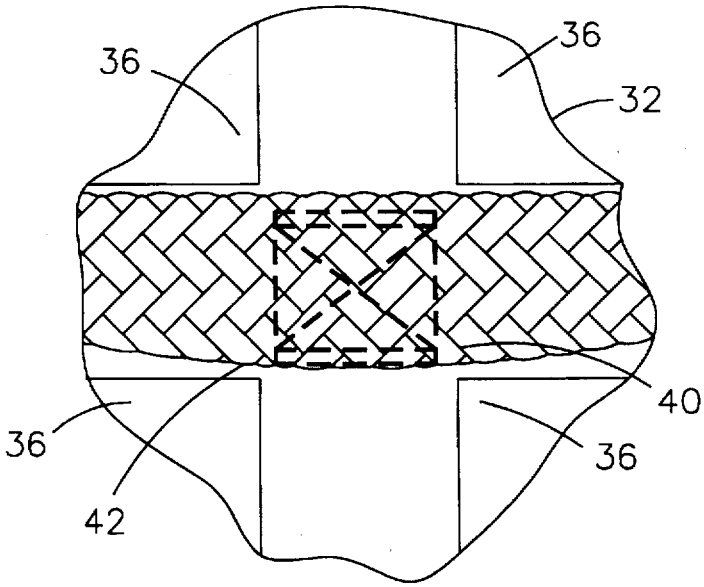
FIG. 9 shows an end-to-end splice between two hollow braid ropes with a sewn connection.

As illustrated in FIG. 9, the support tool 32 of the sewing apparatus used in the present invention is also capable of being used to simply connect end-to-end spliced crossing members 40 and 42 by stitching overlapped portions of the end regions of the members 40,42 of the end-to-end connected netting members.

Figure 10:
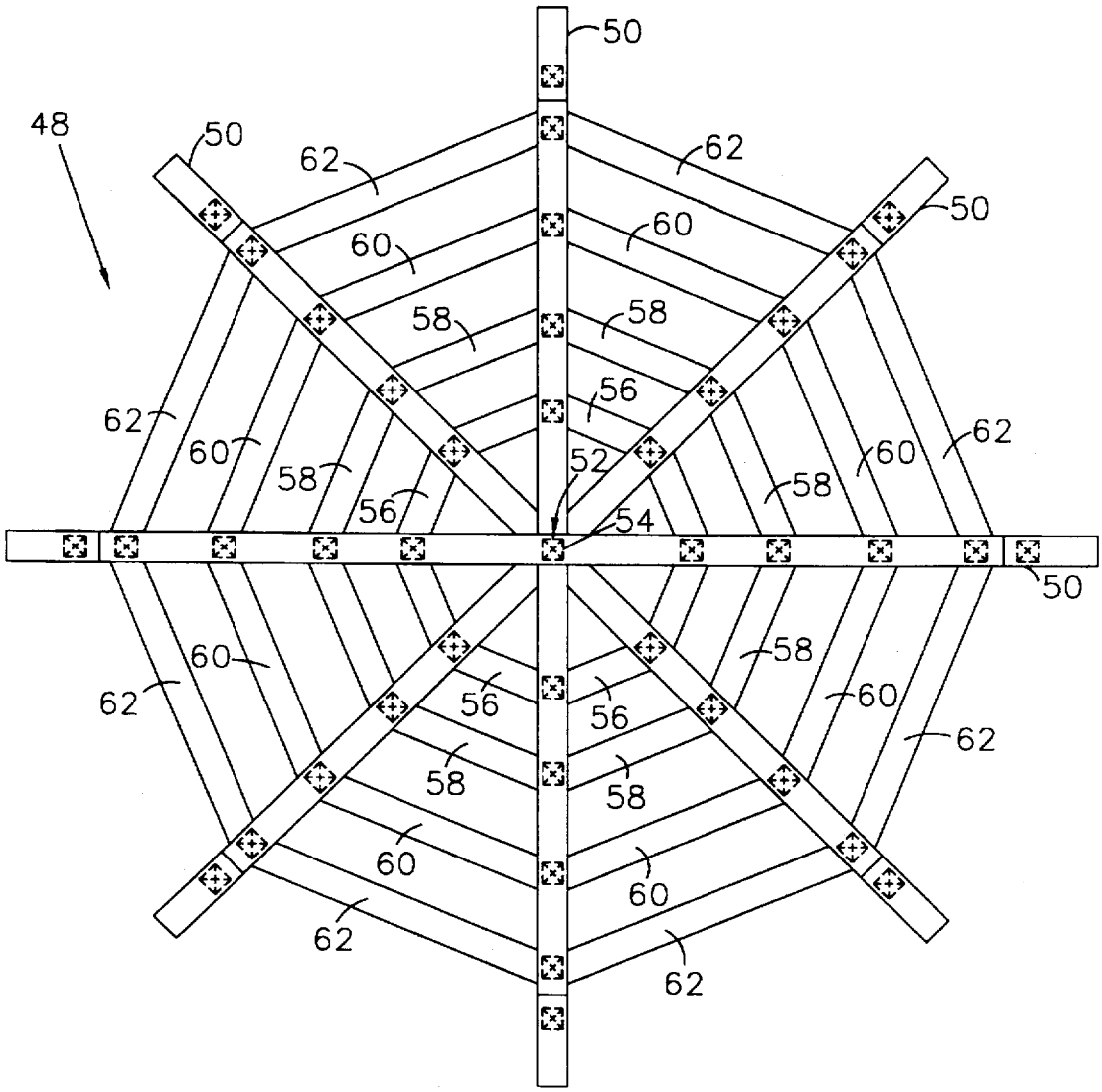
FIG. 10 illustrates an alternative design to the square shaped netting of FIG. 1, in this case showing a spider web flat construction.

Referring now to FIG. 10, therein illustrated is another embodiment of a flattened net construction assembled with sewn intersections. As seen, the net 48 is comprised of a plurality of main crossing members 50,50 which intersect at a common central point 52 as defined by a sewn intersection 54. Disposed radially about a central connecting point 54 and intersecting the main crossing members 50, are a plurality of subcrossing members 56,58,60 and 62, which are placed in face to face confrontation with the main crossing members, i.e. with width dimensions in parallel with one another, to create the spider web like arrangement. At the points of crossing, each main and subcrossing member is connected by a sewn intersection similar to those discussed previously. Each of the subcrossing members referenced at 56,58,60 and 62, may be an individual length connected between consecutive ordered main members, or may be comprised of a single length of material which is folded on itself and connected to the main crossing members at radially equidistant points taken relative to the center 52 of the web. Thus, in this way the flat construction of the netting material lends itself to the fabrication of numerous designs.

Figure 11:
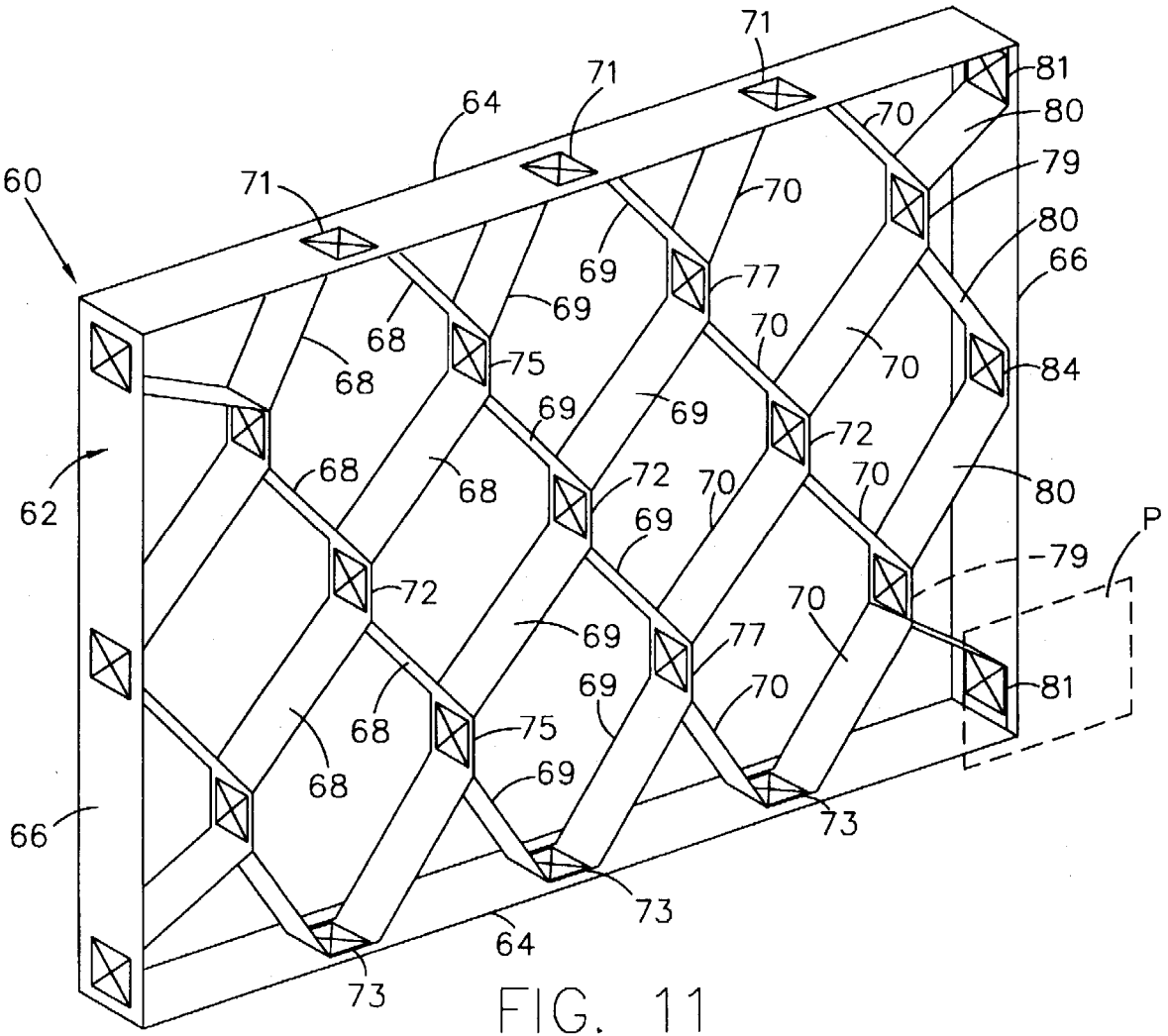
FIG. 11 is a prospective view of another embodiment of the invention wherein the net member lattice is formed to create a diamond configuration.
Figure 12:
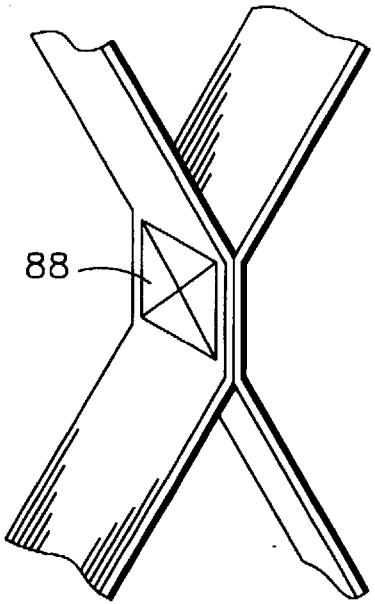
FIG. 12 is a partially fragmentary view of a sewn intersection of the net of FIG. 11.
Figure 13:
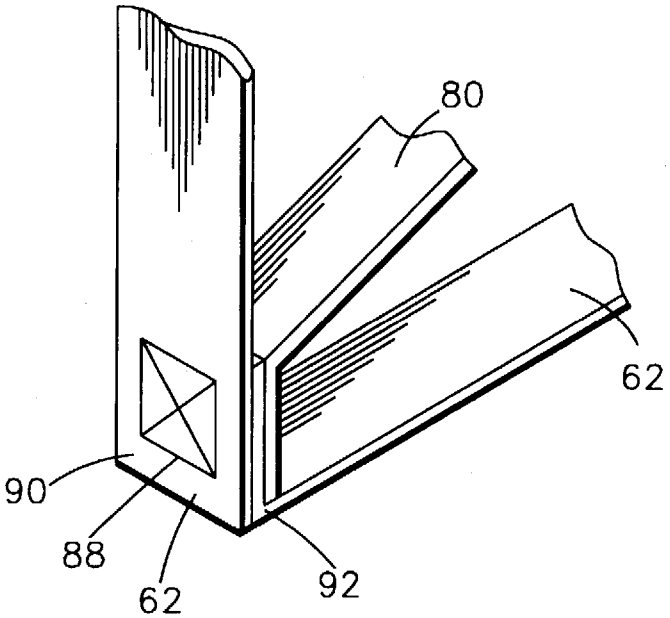
FIG. 13 is a partially fragmentary view showing in detail the corner connection of the net of FIG. 11.

Referring now to FIGS. 11 through 13, it should be seen that the flat configuration of the netting material also lends itself to fabrication "out of plane" with the generally flat dimension W of the members. As illustrated in FIG. 11, the net 60 includes a border member 62 having opposed sides 64,64 and 66,66 defining the flat dimensions of the members to create a generally closed shape for the net which is oriented perpendicularly to the plane P which contains the net structure. Each of the intersecting members which comprise the matrix of the net in the illustrated case include an elongated length of material 68, 69 and 70 which is doubled back on itself at the connection illustrated at 71,71 with the border 62 and is joined intermediately of its length at points such as 72 to create a node along a given double-back length of material. As between successively situated doubled-back lengths of material, such as between lengths 68,69 and 70, the right-most half of the double-back length 68 attaches to the left-most half 69 at juncture points 75,75 and the right-most half of the loop material 69 attaches to the left-most half of the loop material 70 at points 77,77 while the right-most half of the double-back length 70 is connected at points 79,79 with a single length member 80 which connects at its free ends to the border 62 at points 81,81. The end piece 80 also is connected to the border at 62 intermediate its length at points 84 corresponding to the location of the side-stitched connections 72,72. In this way, a generally honeycombed crossing arrangement is achieved.

As illustrated in FIG. 12, the connection between a double-back length of the net members 68,69 and 70, or as between juxtaposed right-most and left-most lengths of different doubled back half members, 12 is readily accomplished by a flat stitch across the confronting lengths of material. Additionally, as seen in FIG. 13, the corner connection illustrated therein includes the connection of the border member 62 with the end piece 80 and one free end 90 of the border with the other free end 92 through the connection of the stitching 88.

Figure 16:
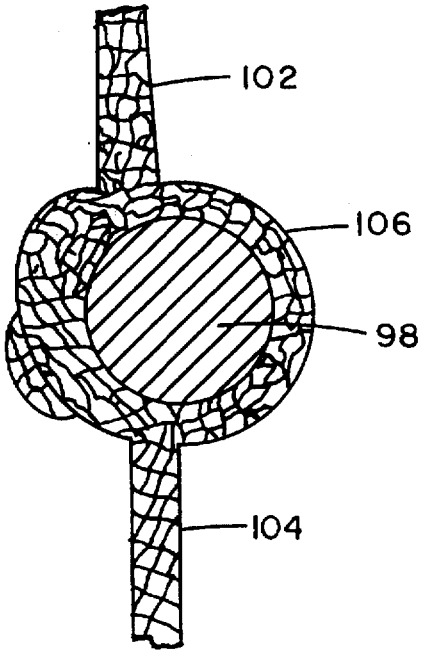
FIG. 16 is a partially fragmentary side elevation view of the rope to rung connection of the structures in FIGS. 14 and 15.
Figure 14:
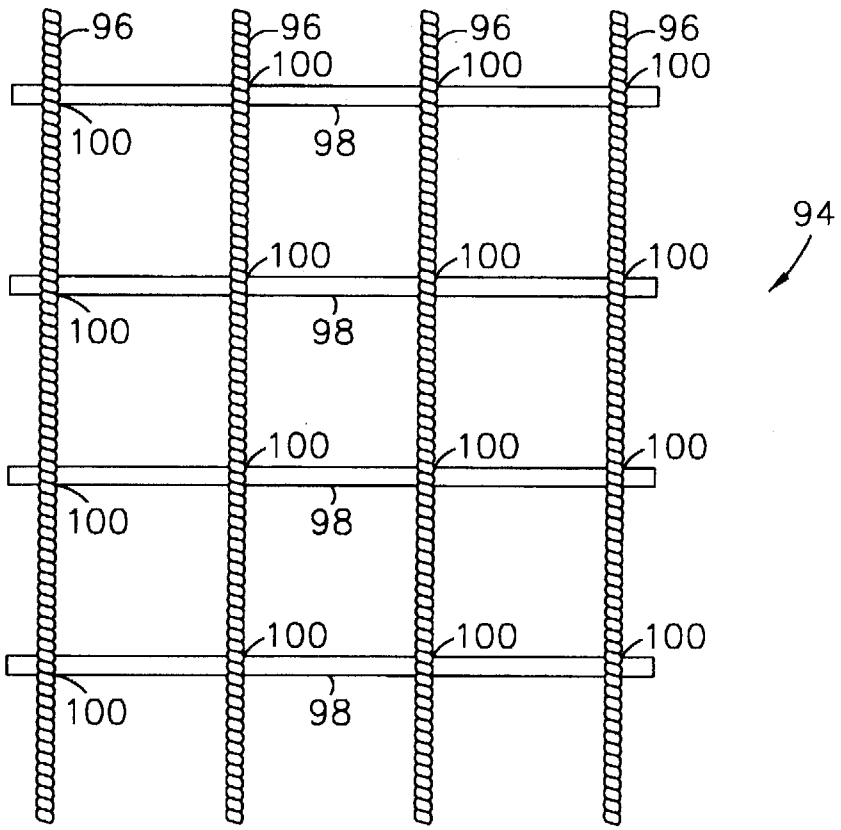
FIG. 14 is an alternative embodiment of the net structure wherein the rungs of the net are comprised of rigid bar-like members.
Figure 17:
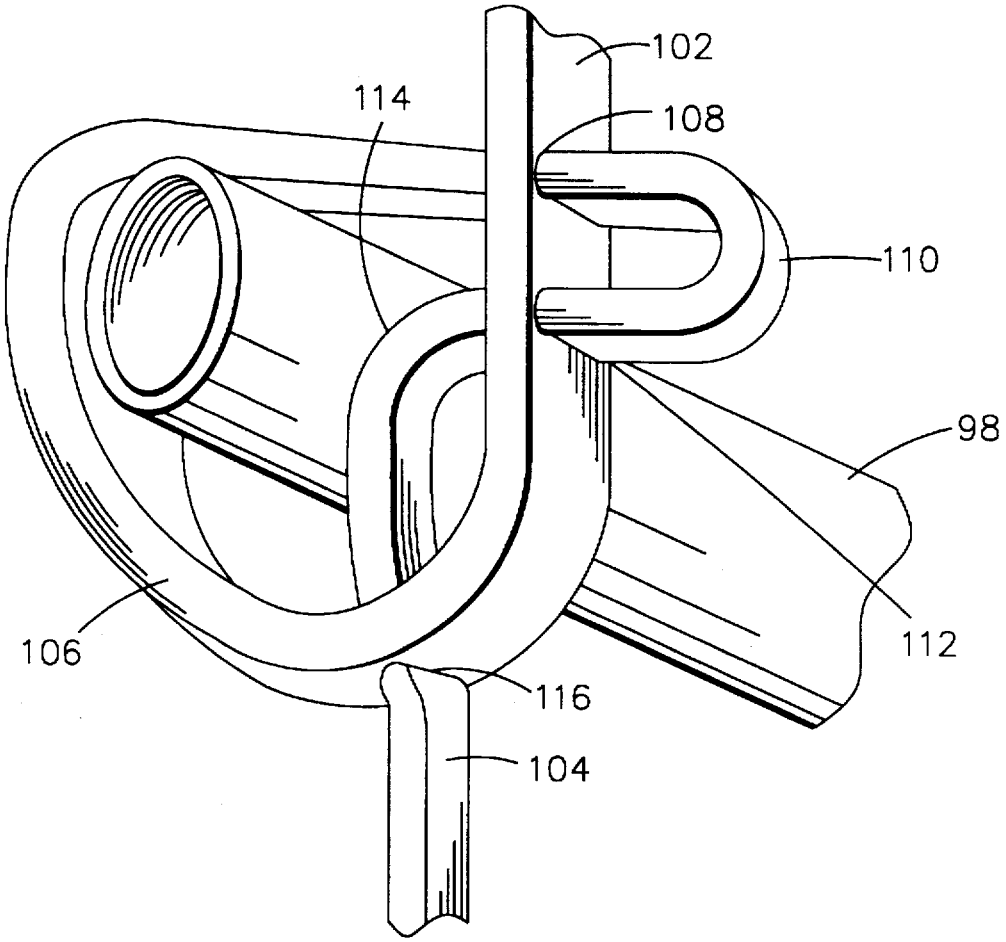
FIG. 17 is a partially fragmentary view illustrating the knotting structure of FIG. 16.

Referring now to FIGS. 14 through 19, an alternative embodiment of a climbing structure is shown therein. As illustrated in FIG. 14, a climbing apparatus generally illustrated as 94 includes a plurality of vertically disposed rope members 96,96 to which are connected a plurality of transversely extending rigid members 98,98 connected to the rope members 96 through knotted connections 100,100. The knotted connections 100,100 are illustrated in detail in the embodiment of FIGS. 16 and 17, and in a second embodiment in FIGS. 18 and 19. Referring first to the embodiment of FIGS. 16 and 17, it should be seen that the member 98 as shown on FIG. 17 is one having a contiguous noninterrupted outside surface about which the rope member 96 surrounds. The rope member 96 is a hollow braid rope of the type illustrated in FIG. 4*a*, 4*b* or 4*c* which lends itself to being readily pierced in the manner illustrated in FIG. 17. As seen in FIGS. 16 and 17, the illustrated knot is defined by an upward portion 102 and a bottom portion 104 of the rope member 96 interconnected by a locked loop 106 which surrounds the circular surface of the rigid member 98. The rigid members 98 can take the form of a hollow plastic tubing or a wooden dowel. The locked loop 106 is made by wrapping a portion of the rope about the surface of the transverse rigid member 98 such that it intersects with and pierces the upper portion 102 at a point generally even with the top of the transverse member at the illustrated intersection 108. Thereafter, the length of rope which pierces the portion 102 is turned 180° on itself at the identified loop 110 and is thereafter caused to re-pierce the length 102 at the illustrated point 112 where it extends downwardly between the loop 106 and the rigid transverse member 98 at the identified length portion 114 until it again intersects with the loop 106 and is thereafter caused to pierce the loop at 116 and proceed outwardly of it to create the lower length portion 104 of the rope member 96. The knot is thereafter pulled tightly about the rigid transverse member 98 to thereafter cause it to be secured against movement relative to the remaining length of the rope.

Figure 15:
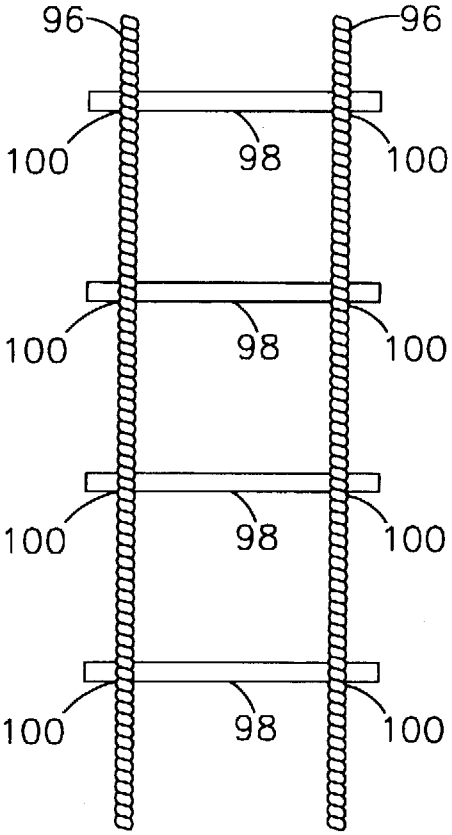
FIG. 15 is a partially fragmentary view of another embodiment to the invention in which the rope members and rigid bar members are used to create a ladder.
Figure 18:
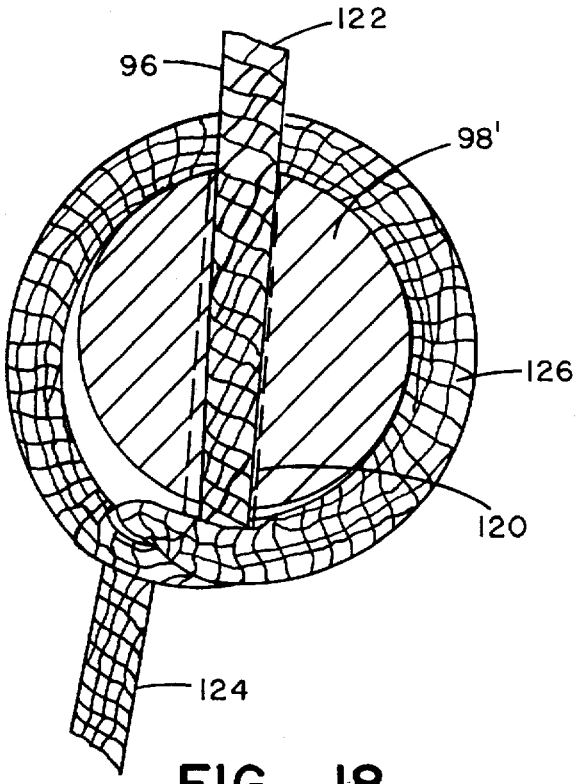
FIG. 18 is another alternate embodiment of the knotting structure of FIGS. 16 and 17.
Figure 19:
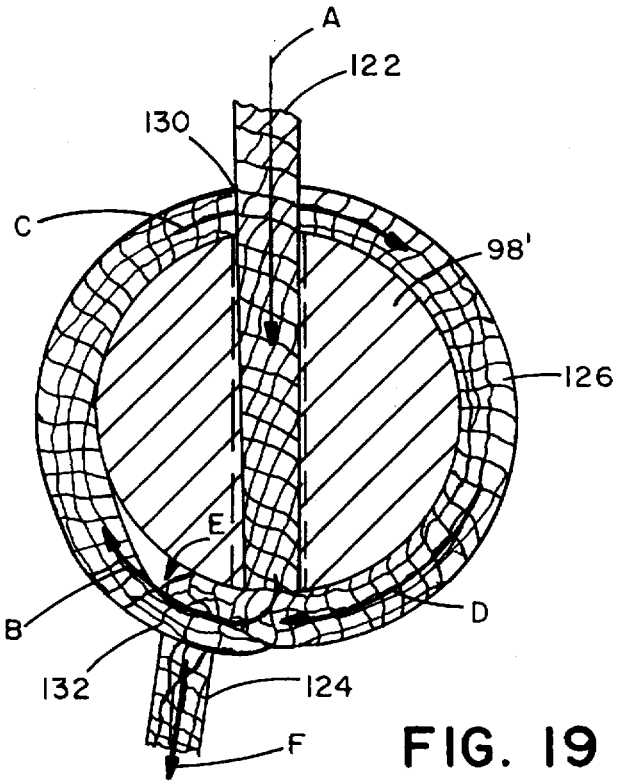
FIG. 19 is a detailed illustration of the connection of FIG. 18.

Referring now to FIGS. 18 and 19, therein shown is an alternative form of the knotted connection 100 wherein the transverse rigid member therein illustrated as element 98' differs from that illustrated in FIGS. 16 and 17 in that the member 98' includes a diametrically extending opening 120 through which is passed the rope 96. The rope 96 has an upper portion 122 and a lower portion 124 interconnected by a locking loop 126 which connects the rope to the rigid transverse member 98'. In this embodiment, the rope 96 is first passed through the opening 120 in the member 98' as indicated by the arrow A. Once the rope exits the opening it is turned clockwise in the direction of arrow B and is wrapped upwardly around the member 98' until it intersects with the upper portion 122 of the rope 96 at the indicated juncture 130. As illustrated by the arrow C, the upper portion 122 of the rope is thereafter pierced through by the left side of the loop 126 and thereafter continues to be wrapped about the right side of the member 98' as indicated by the arrow D. As illustrated by the arrow E, the lower end of the loop 126 is pierced by the free end of the rope 96 or pulled between the outer surface of the rigid member 98' and the loop 126 at point 132 and then downwardly along line F to create the locking loop 126. As illustrated in FIGS. 14 and 15, either of these locking loops is capable of successfully connecting the rope 96 to the transverse rigid members either to create a ladder design or a larger net structure.

Figure 20:
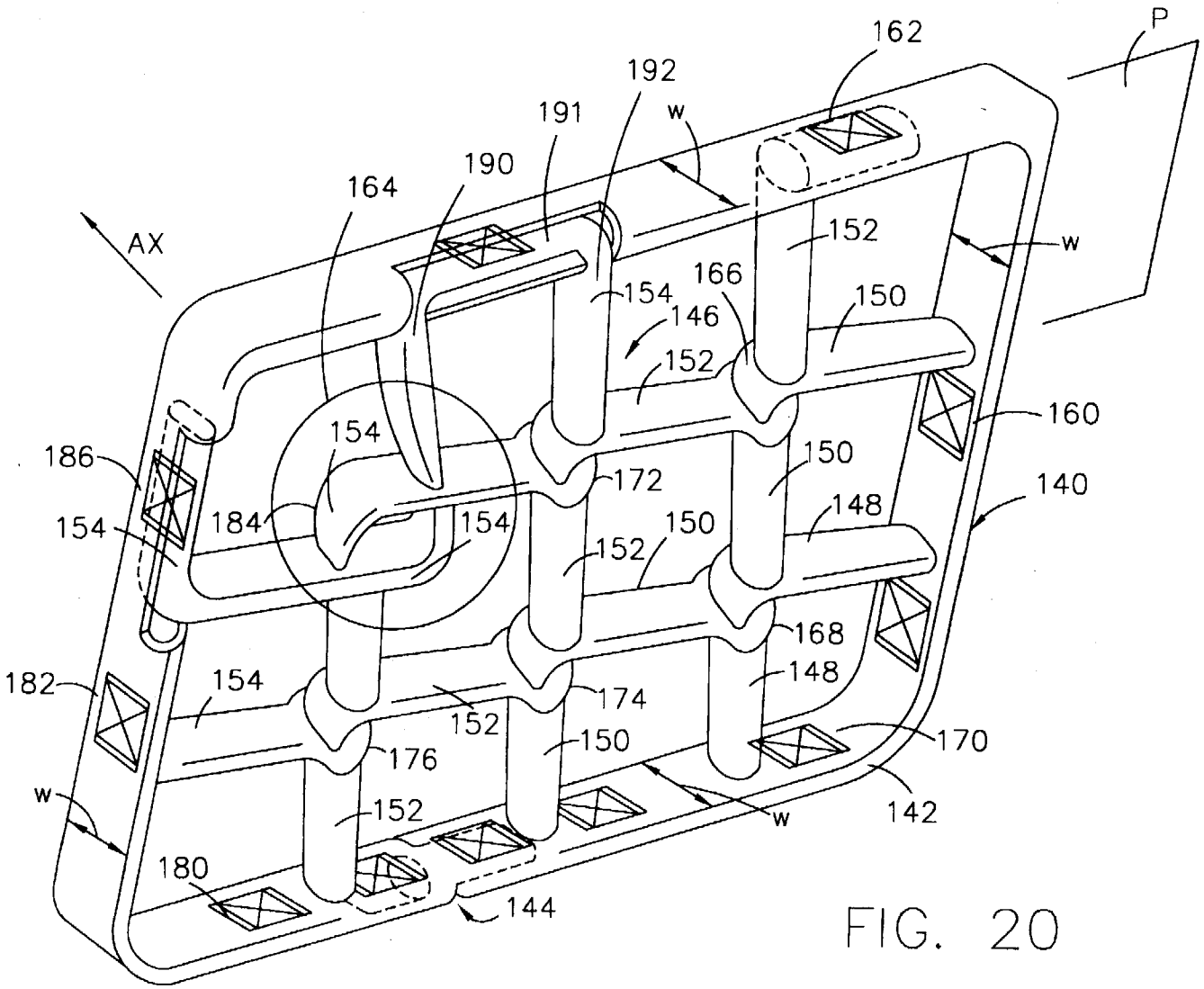
FIG. 20 is an alternative embodiment of a net structure using flattened rope members.
Figure 21:
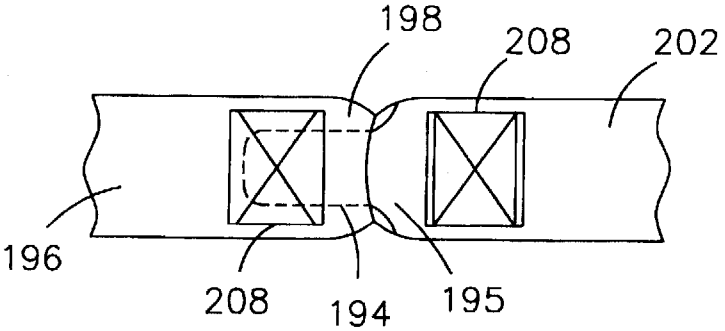
FIG. 21 is a partially fragmentary view of the end connection of the net in FIG. 20.

Referring now to FIGS. 20 and 21, an alternative embodiment of a net construction is shown therein as referenced generally by the numeral 140. The net 140 is defined in shape by a border member 142 which is enclosed at an end-to-end connection 144 and is formed from a braided hollow rope such as shown in greater detail with respect to FIG. 4*a* ,4*b* or 4*c*. Within and connected to the border is disposed a grid 146 of interconnected crossing members which make up the rails and rungs of the net. The border member 142 and the grid 146 have an out-of-plane construction meaning that the width dimension W of the rope faces the opposed width dimension within the enclosed shape defined by the border of 142. In other words, the members constituting the border member 142 and the grid 146 are oriented throughout such that the width dimension of each of the members extend parallel to a line AX which is oriented generally perpendicular to the plane P which includes the net structure.

In the illustrated example, connected to the border 142 is a matrix 146 of interconnected crossing members therein indicated at 148, 150, 152 and 154. Starting at the top right corner, it should be seen that the crossing members 150 and 152 each respectively pierce corresponding portions of the border 142 and are redirected at a right angle turn and thereafter are secured within the hollow confines of the border at the stitching points 160 and 162, respectively. Thereafter, the free ends of these members are caused to cross-pierce one another in the manner illustrated in the exploded view referenced at 164. That is, at 166, the member 150 is caused to pierce the member 152 and be redirected at a 90° angle toward the lower portion of the border 142 and the member 152 is caused to pierce the member 150 and be redirected at a 90° angle toward the left portion of the border 142. Thereafter, the member 150 is caused to cross-pierce with member 148 at the juncture 168 whereupon the member 148 is redirected at a 90° angle toward the bottom of the border 142 and is thereafter caused to pierce the border and be turned 90° and be thereafter stitched at 170. In a like manner, the member 152 cross-pierces at node 172 with member 154 and is redirected downwardly to again cross-pierce with member 150 at node 174 where it is redirected 90° to cross-pierce again with member 154 at node 176 and where it is again redirected 90° toward the bottom of the border and is thereafter caused to pierce the border and be turned 90° therein and become secured against movement through the stitching 180. The crossing member 154 is unique in that unlike the other members of the matrix 146, it does not follow a staggered progression diagonally across the border. Instead, one end of the member 154 is secured within the border at 182 and is caused to cross-pierce at 176 with member 152 and with a return portion of its own length at node 184 before proceeding to pierce and turn within the border and then be stitched at 186. The use of the hollow piercable member for the border 142 is an important feature of the invention in that it permits the looping through of one or more crossing members into the border as seen at 191 which at points 190 and 192 enters and exits the border along a length corresponding to the spacing between nodes of the matrix 146.

Figure 22:
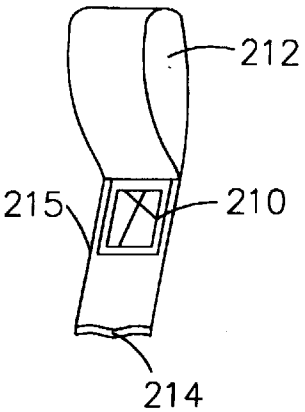
FIG. 22 shows a loop connection.

As illustrated in FIG. 21, the border member being of a hollow construction also permits the end-to-end splice connection 144 to be almost seamless with respect to the remaining length of border material. This is accomplished by cross inserting each of the end regions 200 and 202 of the border 142 into the other and then stitching. More particularly, as indicated in phantom line at 194, the left end 194 of the region 202 is inserted into the hollow confines 196 of the end region 200 border through a separation line 198 within the fabric of the rope material. The right end 195 of the border is then similarly pierced through the left end region 202 and the inserted ends 194 and 195 are then stitched at 208 and 209 to effect the connection. In this way, the ends are locked with one another and present an even contiguous line of material. As illustrated in FIG. 22, such internal piercing and subsequent sewing of a length of material can be used to create an eyelet, for example, as seen in FIG. 22 whereupon a doubledback length is caused to pierce at 213 and then be received within the hollow confines 214 of the member 215, and sewn at 210 to create the loop 212 which can be thereafter sewn to the corners of the net to create an attachment anchor.

By the foregoing, an improved mesh structure with sewn intersections has been disclosed by way of the referred embodiments. However, numerous modifications and substitutions may be had without departing from the spirit of the invention. For example, the terms "right" and "left" as they are discussed with reference to sewn intersections, such as the one shown in FIG. 21, should not be taken as a limitation but only language used as reference terms. Also, as disclosed herein, the concept of using the hollow piercable rope to allow a length of similar rope to enter and exit the border as shown in FIG. 20 at 191, is not limited to the embodiment of a square net configuration, but can be used equally effectively for example in the construction of the spider web type net illustrated in FIG. 10, where a single length of rope can be used to create the radially extending members by threading the single length internally along a main member then redirecting it out of the main member to create the subcrossing members.

Accordingly, the invention has been described by way of illustration rather than limitation.

Having thus described the invention, what is claimed is:

1. A net comprising:

(a) at least one border member defining a closed shape of said net, said at least one border member having first and second ends connected to each other to form said closed shape;

(b) a plurality of elongate crossing members;

(c) said plurality of elongate crossing members and said at least one border member each having a width dimension defining substantially flat opposite sides and having a thickness dimension separating the substantially flat sides from one another, the width dimension thereof being substantially greater than the thickness dimension thereof so as to present a substantially flat tape-like configuration;

(d) said elongate members being arranged within the closed shape of the border member in a matrix of crossing elongate members and being connected to one another at intersections which define said matrix;

(e) said closed shape of said net extending coincidentally through a plane which includes said net;

(f) said matrix of interconnecting elongated members being connected to one another at spatially repeating nodes:

(g) said crossing members which make up said matrix extend perpendicularly to said plane which includes said net, and (h) wherein said net crossing members being formed from a colorfast multi-filament and polypropolyene or polyester hollow rope.

2. A net as defined in claim 1 further characterized by said crossing members include first and second members each connected at one end thereof to perpendicularly disposed lengths of said border which define a first corner of the closed shape of the net, a node in said matrix created by said first elongate crossing member piercing said second elongate crossing member and the first elongate crossing member is thereafter turned laterally 90° after piercing the second elongate crossing member and the second elongate crossing member being turned to pierce the first elongate member and be thereafter turned 90° and directed towards another node created by the second elongate member piercing a third elongate member and the third elongate member piercing back on the second elongate member so to create a progression of like intersections thereby creating a plurality of rails and rungs created between the borders of the net.

3. A net as defined in claim 1 further characterized in that said border member is a hollow rope member which is pierced by the net crossing members such that a portion of the length of the net crossing members extend into the internal chamber of the hollow border member and are thereafter secured against movement by a stitched connection.

4. A net as defined in claim 1 further characterized in that said border member is a hollow border member and is pierced by a length of one of said net crossing members and the length of one of said net crossing members is pulled along the length of the border member internally thereof and exits the border member at a point corresponding generally to where the exiting member will intersect with another crossing member.

5. A net as defined in claim 1 further characterized in that said border member is a single length of hollow rope having first and second ends which are connected to one another by cross-piercing the ends of the border to one another in an axial direction and thereafter stitching one inserted end of the border member to the pierced section of the border and stitching the other end of the border member to the pierced other section of border.

6. A net as defined in claim 5 further characterized by said crossing members which make up said matrix connected to the border member at points therealong such that the flat sides thereof are parallel to the flat sides of said border.

7. A net comprising:

(a) at least one border member defining a closed shape of said net, said at least one border member having first and second ends connected to each other to form said closed shape;

(b) a plurality of elongate crossing members;

(c) said plurality of elongate crossing members and said at least one border member each having a width dimension defining substantially flat opposite sides and having a thickness dimension separating the substantially flat sides from one another, the width dimension thereof being substantially greater than the thickness dimension thereof so as to present a substantially flat tape-like configuration;

(d) said elongate members being arranged within the closed shape of the border member in a matrix of crossing elongate members and being connected to one another at intersections which define said matrix;

(e) said closed shape of said net extending coincidentally through a plane which includes said net;

(f) said matrix of interconnecting elongate members being connected to one another at spatially repeating nodes;

(g) said crossing members which make up said matrix extend perpendicularly to said plane which includes said net, and (h) said crossing members include first and second members each connected at one end thereof to perpendicularly disposed lengths of said border which define a first corner of the closed shape of the net, a node in said matrix created by said first elongate crossing member piercing said second elongate crossing member and the first elongate crossing member is thereafter turned laterally 90 degrees after piercing the second elongate crossing member and the second elongate crossing member being turned to pierce the first elongate member and be thereafter turned 90 degrees and directed towards another node created by the second elongate member piercing a third elongate member and the third elongate member piercing back on the second elongate member so to create a progression of like intersections thereby creating a plurality of rails and rungs created between the borders of the net.

8. A net comprising:

(a) at least one border member defining a closed shape of said net, said at least one border member having first and second ends connected to each other to form said closed shape;

(b) a plurality of elongate crossing members;

(c) said plurality of elongate crossing members and said at least one border member each having a width dimension defining substantially flat opposite sides and having a thickness dimension separating the substantially flat sides from one another, the width dimension thereof being substantially greater than the thickness dimension thereof so as to present a substantially flat tape-like configuration;

(d) said elongate members being arranged within the closed shape of the border member in a matrix of crossing elongate members and being connected to one another at intersections which define said matrix;

(e) said closed shape of said net extending coincidentally through a plane which includes said net;

(f) said matrix of interconnecting elongated members being connected to one another at spatially repeating nodes;

(g) said crossing members which make up said matrix extend perpendicularly to said plane which includes said net, and (h) wherein said border member is a hollow rope member which is pierced by the net crossing members such that a portion of the length of the net crossing members extend into the internal chamber of the hollow border member and are thereafter secured against movement by a stitched connection.

9. A net comprising:

(a) at least one border member defining a closed shape of said net, said at least one border member having first and second ends connected to each other to form said closed shape;

(b) a plurality of elongate crossing members;

(c) said plurality of elongate crossing members and said at least one border member each having a width dimension defining substantially flat opposite sides and having a thickness dimension separating the substantially flat sides from one another, the width dimension thereof being substantially greater than the thickness dimension thereof so as to present a substantially flat tape-like configuration;

(d) said elongate members being arranged within the closed shape of the border member in a matrix of crossing elongate members and being connected to one another at intersections which define said matrix;

(e) said closed shape of said net extending coincidentally through a plane which includes said net;

(f) said matrix of interconnecting elongated members being connected to one another at spatially repeating nodes;

(g) said crossing members which make up said matrix extend perpendicularly to said plane which includes said net, and (h) wherein said border member is a hollow border member and is pierced by a length of one of said net crossing members and the length of one of said net crossing members is pulled along the length of the border member internally thereof and exits the border member at a point corresponding generally to where the exiting member will intersect with another crossing member.

10. A net comprising:

(a) at least one border member defining a closed shape of said net, said at least one border member having first and second ends connected to each other to form said closed shape;

(b) a plurality of elongate crossing members;

(c) said plurality of elongate crossing members and said at least one border member each having a width dimension defining substantially flat opposite sides and having a thickness dimension separating the substantially flat sides from one another, the width dimension thereof being substantially greater than the thickness dimension thereof so as to present a substantially flat tape-like configuration;

(d) said elongate members being arranged within the closed shape of the border member in a matrix of crossing elongate members and being connected to one another at intersections which define said matrix;

(e) said closed shape of said net extending coincidentally through a plane which includes said net;

(f) said matrix of interconnecting elongated members being connected to one another at spatially repeating nodes;

(g) said crossing members which make up said matrix extend perpendicularly to said plane which includes said net, and (h) wherein said border member is a single length of hollow rope having first and second ends which are connected to one another by cross-piercing the ends of the border to one another in an axial direction and thereafter stitching one inserted end of the border member to the pierced section of the border and stitching the other end of the border member to the pierced other section of border.

* * * * *